US008607767B2

(12) United States Patent
Ruppel et al.

(10) Patent No.: US 8,607,767 B2
(45) Date of Patent: Dec. 17, 2013

(54) DEVICE FOR VENTILATING A CRANKCASE

(75) Inventors: Stefan Ruppel, Heidelberg Emmertsgrund (DE); Yakup Ozkaya, Kornwestheim (DE); Klaus Beetz, Karlsruhe (DE); Andreas Enderich, Esslingen (DE); Gerd Kissner, Stuttgart (DE)

(73) Assignee: Mahle International GmbH (DE)

( * ) Notice: Subject to any disclaimer, the term of this patent is extended or adjusted under 35 U.S.C. 154(b) by 570 days.

(21) Appl. No.: 12/302,410

(22) PCT Filed: May 8, 2007

(86) PCT No.: PCT/EP2007/054437

§ 371 (c)(1),
(2), (4) Date: Jul. 26, 2010

(87) PCT Pub. No.: WO2007/137934

PCT Pub. Date: Dec. 6, 2007

(65) Prior Publication Data

US 2010/0294218 A1 Nov. 25, 2010

(30) Foreign Application Priority Data

May 29, 2006 (DE) ..... 10 2006 024 816

(51) Int. Cl.
*F01M 13/02* (2006.01)
*F01M 13/04* (2006.01)

(52) U.S. Cl.
USPC ..... 123/572

(58) Field of Classification Search
USPC ..... 123/572–574, 41.86
See application file for complete search history.

(56) References Cited

U.S. PATENT DOCUMENTS

| | | | | |
|---|---|---|---|---|
| 1,872,609 | A | 8/1932 | Schittke | |
| 3,822,532 | A | 7/1974 | Weisgerber | |
| 5,542,402 | A * | 8/1996 | Lee et al. | 123/573 |
| 5,803,025 | A * | 9/1998 | Feucht | 123/41.86 |
| 7,204,241 | B2 * | 4/2007 | Thompson et al. | 123/572 |
| 2002/0088212 | A1 | 7/2002 | Ernst et al. | |

(Continued)

FOREIGN PATENT DOCUMENTS

| | | |
|---|---|---|
| AT | 412070 | 9/2004 |
| DE | 3702765 | 8/1988 |

(Continued)

OTHER PUBLICATIONS

English Abstract for JP-09096209.

(Continued)

*Primary Examiner* — M. McMahon
(74) *Attorney, Agent, or Firm* — Rader, Fishman & Grauer PLLC

(57) ABSTRACT

The invention relates to a device (1) for ventilating a crankcase of an internal combustion engine, comprising a ventilation line leading from the crankcase to the suction line of the internal combustion engine, an oil-mist separator (2) for separating the oil parts from the blow-by-gases containing the oil-mist from the crankcase is arranged in the path thereof. Also, said device (1) comprises a pump (3) which is arranged upstream of the oil-mist separator (2) and which is used to produce a negative pressure. The invention is characterized in that the oil-mist separator (2) and the pump (3) are embodied as connected modules thus providing a particularly compact structure.

14 Claims, 1 Drawing Sheet

(56) References Cited

U.S. PATENT DOCUMENTS

| | | | | |
|---|---|---|---|---|
| 2003/0150436 | A1* | 8/2003 | Stegmaier et al. | 123/572 |
| 2003/0178014 | A1* | 9/2003 | Sauter et al. | 123/572 |
| 2004/0112346 | A1* | 6/2004 | Ahlborn et al. | 123/572 |
| 2004/0173193 | A1* | 9/2004 | Burgess et al. | 123/573 |
| 2004/0261776 | A1* | 12/2004 | Knaus et al. | 123/572 |
| 2005/0000496 | A1* | 1/2005 | Norrick | 123/563 |
| 2006/0062699 | A1 | 3/2006 | Evenstad et al. | |
| 2006/0090737 | A1* | 5/2006 | Pietschner | 123/572 |

FOREIGN PATENT DOCUMENTS

| | | | |
|---|---|---|---|
| DE | 20302824 | | 8/2004 |
| DE | 20318633 | | 4/2005 |
| DE | 102005043198 | | 3/2006 |
| EP | 1068890 | | 10/2005 |
| JP | 63-90013 | | 6/1988 |
| JP | 1-122821 | A | 5/1989 |
| JP | 5-83310 | | 12/1993 |
| JP | 09096209 | | 4/1997 |
| JP | 11-117709 | A | 4/1999 |
| JP | 11-141325 | | 5/1999 |
| JP | 2003-500588 | A | 1/2003 |
| WO | WO-02/070871 | | 9/2002 |

OTHER PUBLICATIONS

English abstract provided for AT-412070.
English abstract provided for DE-20318633.
English abstract provided for DE-30702765.
English abstract provided for JP-11-141325.
English abstract provided for JP-1-122821.
English abstract provided for JP-11-117709.

* cited by examiner

DEVICE FOR VENTILATING A CRANKCASE

CROSS-REFERENCES TO RELATED APPLICATION

This application is a National Stage application which claims the benefit of International Application No. PCT/EP2007/054437 filed May 8, 2007, which claims priority based on German Patent Application No. DE 10 2006 024 816.3, filed May 29, 2006, both of which are hereby incorporated by reference in their entirety.

The invention relates to a device for ventilating a crankcase of an internal combustion engine according to the preamble of claim 1.

A device of the generic kind is known from the practice of engine construction, in particular for automobiles. The object of such a device consists in maintaining a negative pressure in the crankcase of the internal combustion engine, which is required for technical and legal reasons, by ventilating the crankcase. Oil parts carried along in the ventilation gas of the crankcase are separated in an oil mist separator, and the separated oil is preferably recirculated to the lubrication oil circuit of the internal combustion engine. The gas cleaned from oil gets into the suction tube of the internal combustion engine and subsequently undergoes the combustion taking place in the cylinder.

From WO 02/070871 A2 a device is known for the ventilation of a crankcase of an internal combustion engine, comprising a ventilation line, which leads from the crankcase to a suction tube of the internal combustion engine, and in the path of which an oil, mist separator is arranged. In the further path of the ventilation line, a pump is arranged by means of which a negative pressure in the crankcase can be produced with respect to the ambient air pressure. This is intended to avoid that a pressure builds up in the crankcase which is too high, in particular, when the internal combustion engine is operated in its no-load range.

The invention is concerned with the problem to improve a generic device compared to the previously known prior art such that, in particular, a reduced required installation space can be achieved.

This problem is solved by means of the subject matter of the independent claim 1. Preferred embodiments are subject matter of the dependent claims.

The invention is based on the general idea to embody\, for a device for the ventilation of a crankcase of an internal combustion engine comprising an oil mist separator and a pump downstream thereof for producing a negative pressure, the oil mist separator and the pump as connected modules. Hereby a particular compact structure is achieved, which is of great advantage with respect to a consistently reduced installation space available in an engine compartment. Moreover, another line between oil mist separator and the pump is eliminated so that, on the one hand, the component variety is reduced, and, on the other hand, installation cost can be saved. In the module according to the invention, comprising an integrated oil mist separator and an integrated pump, the pump is arranged downstream of the oil mist separator in a known manner. It is principally also thinkable that in such a module, a mounting space can be found which is advantageous for maintenance purposes so that a replacement of the oil mist separator or the maintenance of the pump is simpler, and hence more cost effective.

Preferably, at least a portion of a stator of the pump is integrated in the oil mist separator. Hereby, the close engagement between pump and the oil mist separator is apparent, which is reflected in a very compact structure and hence in a small required installation space. At the same time, with this structure, a simplified maintenance is possible, since a portion of the stator of the pump is formed at the same time as deflector wall for the oil mist separator, and, in case that this deflector wall is covered with an adequate non-woven fibre, or the like, allows a simplified access thereto.

In a further advantageous embodiment of the solution according to the invention, the oil mist separator comprises an impactor having flow nozzles and a deflector wall opposite thereto. Such oil mist separators formed as impactor are known for a long time from, for example, EP 1 068 890 B1, and ensure a reliable oil separation over a long operating time. Of course, it is also thinkable here, that an additional oil mist pre-fractionator, or an additional oil mist post-fractionator is arranged upstream or downstream, respectively, of the oil mist separator. As an upstream oil mist pre-fractionator, for example, a cyclone can be considered, which causes an additional cleaning of the blow-by gases containing oil mist. Such a cyclone can also be used as post-separator.

In a particularly preferred embodiment, a fan blade of the pump is arranged axially to the axis of the oil mist separator and rotates radially outside around the same. Such an arrangement of the fan blade of the pump ensures a particularly compact structure, whereby the required installation space of the module formed by the oil mist separator and the pump can be reduced. At the same time, in such an arrangement, a part of the oil mist separator can be formed by parts of the stator of the pump, whereby the compactness of the module according to the invention can be additionally increased.

The oil mist separator and the pump preferably comprise a common housing, or are arranged in a common housing, respectively. Also this measure supports the compact structure of the module formed by the oil mist separator and the pump, and, in addition, eliminates the provision of a further housing, for example for the pump or the oil mist separator. A common housing hence reduces the component variety, and helps reduce the manufacturing cost of the module.

Advantageous embodiments, which are explained in more detail below, are each illustrated schematically in the drawings.

In the figures

Figure 1:
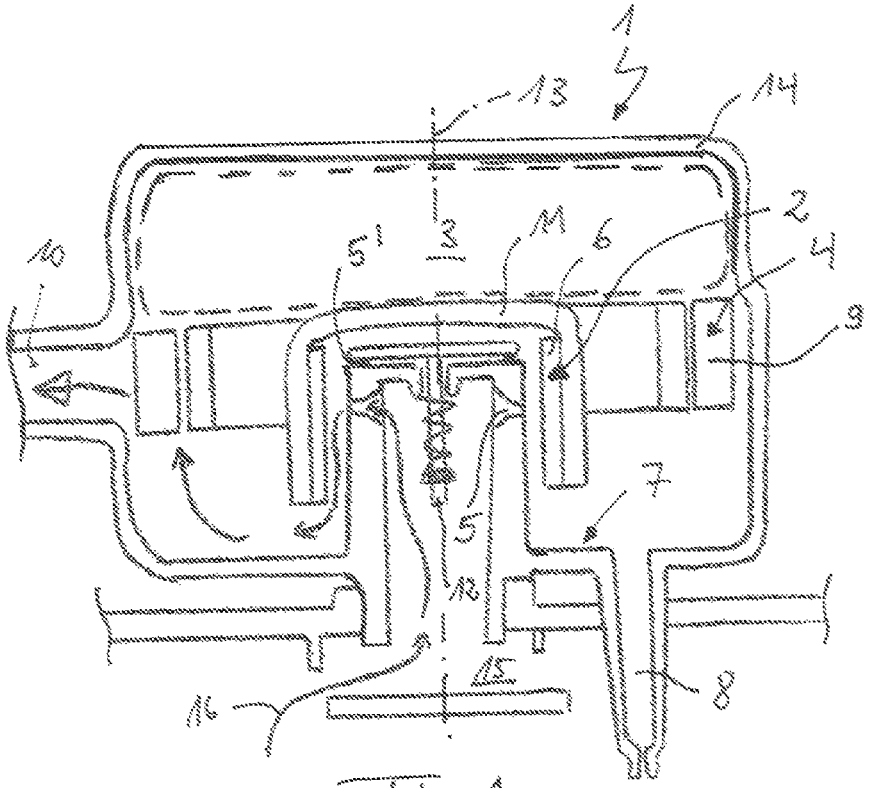
FIG. 1 shows a cross section through a device according to the invention.

In FIG. 1 is illustrated a device 1 according to the invention for the ventilation of a crankcase, which is not shown, of an internal combustion engine. The device 1 is arranged here in a ventilation line, which leads from the crankcase to a suction line, or intake line, respectively, of the internal combustion engine, and comprises substantially an oil mist separator 2, and a pump 3 arranged downstream for producing a negative pressure. Here, the pump 3 is arranged downstream of the oil mist separator 2 so that only cleaned blow-by gases get in contact with the fan wheel 4 of the pump 3. Generally, the pump 3 serves for producing a negative pressure which is intended to ensure that also in the no-load operation of the internal combustion engine, a gas pressure which is too high can be avoided, and the blow-by gases occurring in the crankcase are reliably sucked out.

Figure 2:
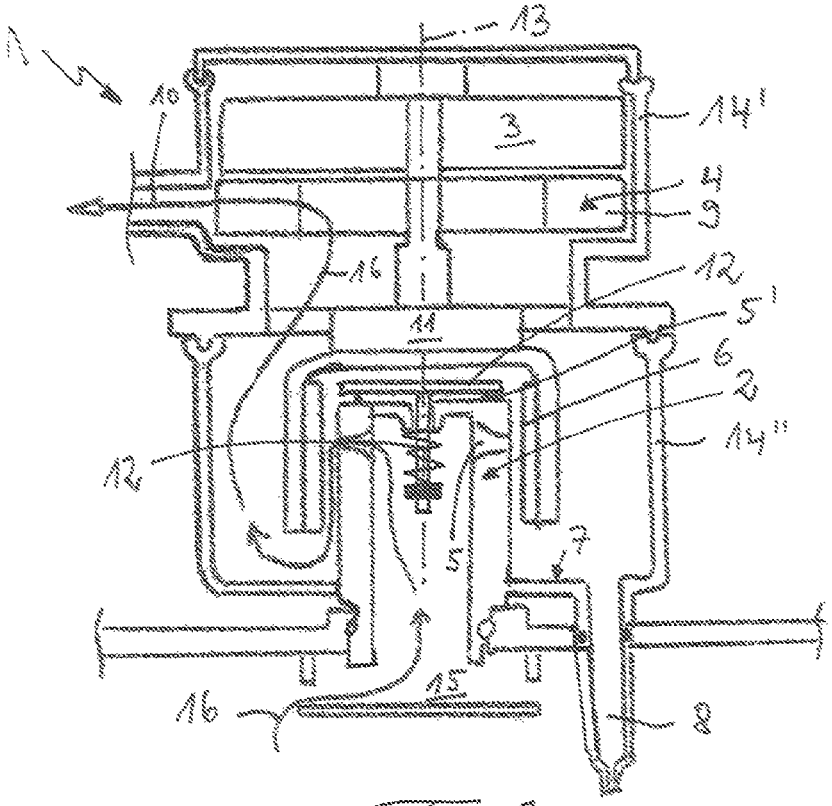
FIG. 2 shows an illustration as in FIG. 1 but for a different embodiment.

According to the invention, as shown in FIGS. 1 and 2, the oil mist separator 2 and the pump 3 are embodied here as connected modules. This allows a particularly compact structure of the device 1, and reduces its required installation space, which is of great advantage in particular with respect to the low installation space available in today's engine compartments.

The oil mist separator 2 comprises nozzles 5, in particular flow nozzles or acceleration nozzles, respectively, which accelerate the gas flow flowing through the device 1 and lead it to a deflector wall 6 opposite of the nozzles 5. The deflector wall 6 is covered here, for example, with a fabric or a non-woven fibre, which again improves the absorption effect. The oil collected at the deflector wall flows, according to FIGS. 1 and 2, in direction of the gravity to a bottom 7 of the oil mist separator 2, and from there to an oil discharge 8, which is preferably connected with an oil reservoir which is not shown, so that the discharged oil can be recirculated again in a lubrication circuit.

It is generally thinkable that the oil mist separator 2, as shown in FIGS. 1 and 2, is formed as impactor, wherein additionally an oil mist pre-fractionator or oil mist post-fractionator, respectively, can be provided. Such an oil mist pre-fractionator, which is arranged upstream of the impactor or the oil mist separator 2, respectively, can be formed, for example, as a cyclone.

According to FIGS. 1 and 2, the pump is formed as an annular ducted fan, which, via its fan blades 9, pushes cleaned blow-by gas towards an outlet 10 thereby producing a negative pressure in the oil mist separator 2 or in the crankcase located upstream thereof, respectively. Of course, other pump types or fan types, respectively, which are built compact and can produce the required negative pressure, are also conceivable. The pump according to the FIGS. 1 and 2 indicated by the reference number 3 represents here also the pump 3 installation space so that, for example, a support or drive, respectively, of the pump 3 can be placed therein.

As is further apparent from FIG. 1, at least a portion of a stator of the pump 3 is integrated in the oil mist separator 2, wherein the stator 11, according to FIG. 1, forms the deflector walls 6.

Furthermore, it can be provided that an oil mist separator 2 is formed as a switchable oil mist separator, comprising a vacuum valve 12, in particular a spring-loaded vacuum valve 12, which, at a defined negative pressure, causes a redirection of the flow and releases further nozzles 5'. In the FIGS. 1 and 2, for this, the vacuum valve 12 is formed as a poppet valve. With open vacuum valve 12, therefore, blow-by gas flows through the nozzles 5 as well as through the further nozzles 5'. Both nozzles 5 and 5' have in common that they direct the accelerated blow-by gas flow onto the deflector wall 6, thereby causing an oil mist separation thereon.

In FIG. 1, the fan blade 9 of the pump 3 is arranged coaxial to the axis 13 of the oil mist separator 2 and rotates radially outside around the same. In contrast, the fan blade 9 of the pump 3, according to FIG. 3, is arranged offset in axial direction to the oil mist separator 2, whereby the installation height of the variant of the device 1 shown in FIG. 2 increases slightly. The oil mist separator 2, as well as the pump 3, are arranged, according to FIG. 1, in a common housing 14 so that compared to a separate formation of the two components, one housing can be saved. Unlike this, according to FIG. 2, the pump 3 and the deflector wall 6 of the oil mist separator 2 are arranged in a first housing part 14', while the nozzles 5 of the oil mist separator 2 are arranged in a second housing part 14", which is connectable with the first housing part 14'. This provides the advantage, that the individual housing parts 14' and 14" allow a disassembling of the device 1, which is particularly advantageous for maintenance. Altogether, the device 1 is characterized by a low installation height, for example 45 mm, and a small width, for example 90 mm.

Hereinafter, the functionality of the device 1 according to the invention is described briefly in more detail:

By means of the pump 3, the fan wheel 4 of the same, including the fan blades 9 arranged radially outside thereon, are set in a rotation around the axis 13, whereby blow-by gases are pushed towards the outlet 10 and are sucked in from an inlet 15. If the blow-by gases containing oil mist enter the oil mist separator 2 via the inlet 15, then they flow along the flow direction 16 up to the nozzle or the nozzles 5, respectively, at which the blow-by gases are accelerated. Opposite to the nozzles 5, a deflector wall 6 is arranged, onto which the blow-by gases impinge, thereby releasing at least a large proportion of their oil carried along to the deflector wall 6. The blow-by gases flow further along the direction 16 towards the fan blade 9, and from there, to the exit 10. The oil collected at the deflector wall 6 runs in direction of the gravity and drips onto the bottom 7, which, at its lowest point, comprises the oil discharge 8. This oil discharge 8 is preferably connected with the oil reservoir and recirculates the separated oil to the oil circuit. By means of the device 1 according to the invention, a particularly compact structure can be achieved, which, in addition, saves an additional housing, either for the oil mist separator 2, or for the pump 3, and, moreover, eliminates the need for additional connection lines between the oil mist separator 2 and the pump 3.

All features illustrated in the description and in the following can be essential for the invention, individually, as well as combined in any form.

The invention claimed is:

1. A device for ventilating a crankcase of an internal combustion engine, comprising:

a ventilation line including an oil mist separator, the ventilation line leading from the crankcase to a suction line of the internal combustion engine, in the path of which the oil mist separator for separation of the oil parts from the blow-by gases containing the oil mist from the crankcase is arranged;

a pump arranged downstream of the oil mist separator for producing a negative suction pressure; and at least one drive and a fan wheel connected to the pump;

the oil mist separator and the pump are connected modules, wherein the pump is arranged together with the oil mist separator in a housing formed in at least one part, the oil mist separator is formed as a switchable oil mist separator comprising a vacuum valve, and wherein the oil mist separator comprises an impactor, the oil mist separator formed as the impactor comprises flow nozzles and a deflector wall generally opposite thereto.

2. The device according to claim 1, characterized in that the pump is formed as an annular ducted fan.

3. The device according to claim 1, characterized in that at least a portion of a stator of the pump is integrated in the oil mist separator.

4. The device according to claim 1, characterized in that the vacuum valve releases further flow nozzles at a defined negative pressure.

5. The device according to claim 1, characterized in that a fan blade of the pump is arranged coaxial to an axis of the oil mist separator, and rotates radially outside around the axis of the oil mist separator.

6. The device according to claim 1, characterized in that a fan blade of the pump is arranged offset in an axial direction to the oil mist separator.

7. The device according to claim 1, wherein the device is part of a crankcase.

8. The device according to claim 2, characterized in that at least a portion of a stator of the pump is integrated in the oil mist separator.

9. The device according to claim 2, characterized in that a fan blade of the pump is arranged coaxial to an axis of the oil mist separator, and rotates radially outside around the axis of the oil mist separator.

10. The device according to claim 2, characterized in that a fan blade of the pump is arranged offset in an axial direction to the oil mist separator.

11. The device according to claim 3, characterized in that a fan blade of the pump is arranged coaxial to an axis of the oil mist separator, and rotates radially outside around the axis of the oil mist separator.

12. The device according to claim 3, characterized in that a fan blade of the pump is arranged offset in an axial direction to the oil mist separator.

13. The device according to claim 4, characterized in that a fan blade of the pump is arranged coaxial to an axis of the oil mist separator, and rotates radially outside around the axis of the oil mist separator.

14. The device according to claim 1, further comprising a second drive and a fan wheel connected to the pump.

* * * * *